US009551248B2

(12) United States Patent
Warey et al.

(10) Patent No.: US 9,551,248 B2
(45) Date of Patent: Jan. 24, 2017

(54) METHOD AND APPARATUS TO RECOVER EXHAUST GAS RECIRCULATION COOLERS

(71) Applicant: GM GLOBAL TECHNOLOGY OPERATIONS LLC, Detroit, MI (US)

(72) Inventors: Alok Warey, Troy, MI (US); Patrick G. Szymkowicz, Shelby Township, MI (US); Sandro R. Balestrino, Plymouth, MI (US); Richard C. Peterson, Troy, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 225 days.

(21) Appl. No.: 13/926,059

(22) Filed: Jun. 25, 2013

(65) Prior Publication Data

US 2014/0020362 A1 Jan. 23, 2014

Related U.S. Application Data

(60) Provisional application No. 61/672,341, filed on Jul. 17, 2012.

(51) Int. Cl.
*F01N 3/08* (2006.01)

(52) U.S. Cl.
CPC ..... *F01N 3/08* (2013.01); *F02M 26/05* (2016.02); *F02M 26/28* (2016.02); *F02M 26/35* (2016.02)

(58) Field of Classification Search
CPC ..... F01N 3/08; F02M 25/07; F02M 25/0731; F02M 25/074; Y02T 10/121
See application file for complete search history.

(56) References Cited

U.S. PATENT DOCUMENTS

| | | | | |
|---|---|---|---|---|
| 6,085,732 | A * | 7/2000 | Wang et al. | 123/568.12 |
| 6,293,337 | B1 * | 9/2001 | Strahle et al. | 165/166 |
| 8,763,394 | B2 * | 7/2014 | Freund | F02D 41/0065 123/568.12 |
| 2003/0213230 | A1 * | 11/2003 | Yahata et al. | 60/278 |
| 2006/0096274 | A1 * | 5/2006 | Fayard | 60/286 |
| 2008/0104948 | A1 * | 5/2008 | Kapparos et al. | 60/297 |
| 2008/0155969 | A1 * | 7/2008 | DaCosta et al. | 60/295 |

* cited by examiner

*Primary Examiner* — Thomas Denion
*Assistant Examiner* — Brandon Lee

(57) ABSTRACT

An apparatus for mitigating fouling within a heat exchanger device includes an internal combustion engine and an external exhaust gas recirculation (EGR) circuit. The internal combustion engine is fluidly coupled to an intake gas manifold upstream of the engine and an exhaust gas manifold downstream of the engine. The EGR circuit is fluidly coupled to the exhaust gas manifold at a first end and is configured to selectively route back exhaust gas flow as EGR flow into the intake gas manifold at a second end. The EGR circuit includes the heat exchanger device for cooling the EGR flow prior to entering the intake manifold and a surface deposit removing device configured to remove surface deposit build-up from within the heat exchanger device when the surface deposit removing device is activated.

20 Claims, 4 Drawing Sheets

METHOD AND APPARATUS TO RECOVER EXHAUST GAS RECIRCULATION COOLERS

CROSS REFERENCE TO RELATED APPLICATIONS

This application claims the benefit of U.S. Provisional Application No. 61/672,341, filed on Jul. 17, 2012, which is incorporated herein by reference.

TECHNICAL FIELD

This disclosure is related to mitigating fouling in exhaust gas recirculation cooler devices for internal combustion engines.

BACKGROUND

The statements in this section merely provide background information related to the present disclosure. Accordingly, such statements are not intended to constitute an admission of prior art.

Exhaust systems transport combustion by-products in the form of exhaust gas flow from the engine through various after treatment devices. Exhaust gas recirculation (EGR) circuits channel a portion of exhaust gas flow back to an intake gas flow to reenter the combustion chambers within cylinders of the engine. The effects associated with the use of EGR, for example the reduction of NOx emissions, are known in the art. EGR circuits are known for use in many different engine types and configurations, for instance in both diesel and gasoline engines.

The exhaust gas flow tapped from the exhaust system for the purpose of controlling combustion within the combustion chamber contain by-products of combustion. Particulate matter (PM) and other combustion by-products travel through the exhaust system with the exhaust gas flow. The recirculated gas flow tapped from the exhaust system is exposed to these by-products. A heat exchanger, such as an EGR cooler device, can include narrow and subdivided exhaust gas flow passages for maximizing heat transfer from the hot gas to a cooling liquid. These narrow exhaust gas flow passages with large surface areas can act as filters to the combustion by-products, collecting particulate deposits on the surfaces within the passages. Such surface deposits within the heat exchanger can have a number of adverse effects upon the heat exchanger, including but not limited to corrosion, increased flow resistance, flow blockage, reduction of heat transfer capacity and noise, vibration, and harshness (NVH). It is therefore desirable to remove surface deposits within the heat exchanger.

SUMMARY

An apparatus for mitigating fouling within a heat exchanger device includes an internal combustion engine and an external exhaust gas recirculation (EGR) circuit. The internal combustion engine is fluidly coupled to an intake gas manifold upstream of the engine and an exhaust gas manifold downstream of the engine. The EGR circuit is fluidly coupled to the exhaust gas manifold at a first end and is configured to selectively route back exhaust gas flow as EGR flow into the intake gas manifold at a second end. The EGR circuit includes the heat exchanger device for cooling the EGR flow prior to entering the intake manifold and a surface deposit removing device configured to remove surface deposit build-up from within the heat exchanger device when the surface deposit removing device is activated.

BRIEF DESCRIPTION OF THE DRAWINGS

One or more embodiments will now be described, by way of example, with reference to the accompanying drawings, in which.

DETAILED DESCRIPTION

Figure 1:
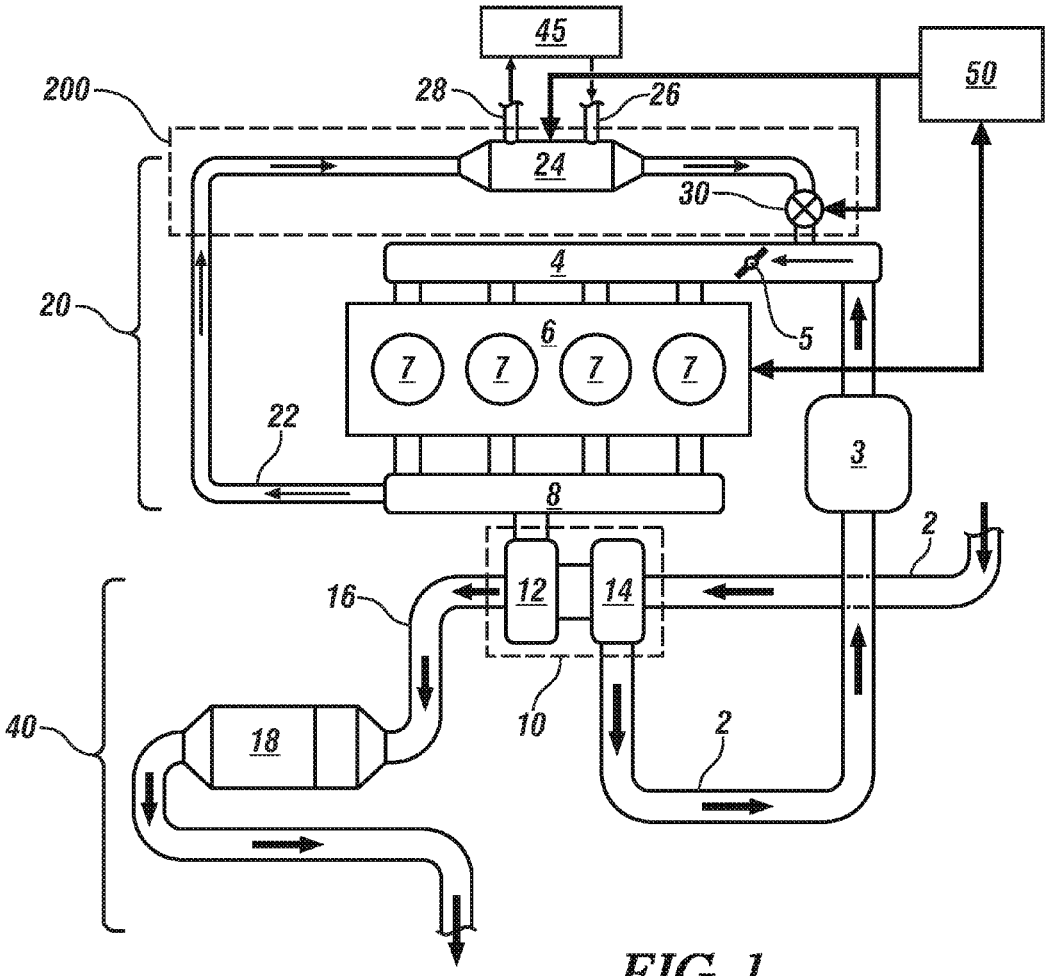
FIG. 1 illustrates an exemplary engine configuration utilizing an exhaust gas recirculation (EGR) circuit, in accordance with the present disclosure.

Referring now to the drawings, wherein the showings are for the purpose of illustrating certain exemplary embodiments only and not for the purpose of limiting the same, FIG. 1 illustrates an exemplary engine configuration utilizing an external exhaust gas recirculation (EGR) circuit in accordance with the present disclosure. An internal combustion engine 6 is includes an exhaust system 40, an intake manifold 4, a turbocharger 10 and the EGR circuit 20. The intake manifold 4 can be interchangeably referred to as an "intake gas manifold" herein. Portion 200 of EGR circuit 20 includes an EGR cooler device 24, a deposit filter 23, and an EGR valve 30. Portion 200 is described in greater detail with reference to FIGS. 2 and 3. The exemplary engine includes four cylinders 7. While the illustrated embodiment depicts four cylinders 7, the engine 6 may include additional or fewer cylinders 7. The engine 6 can have a V-type, W-type or inline-type cylinder configuration. In an exemplary embodiment, the engine 6 is a diesel engine. In an alternative embodiment, the engine 6 is a gasoline engine.

A control module 50 is operatively connected to the engine 6, and acquires data from sensors, and control a variety of actuators of the engine 6. The control module 50 can receive an engine torque command, and generate a desired torque output, based upon operator inputs. Exemplary engine operating parameters that are sensed by the control module 50 using the aforementioned sensors include engine coolant temperature, crankshaft rotational speed (RPM) and position, manifold absolute pressure, ambient air flow and temperature, and ambient air pressure. Combustion performance measurements typically include measured and inferred combustion parameters, including air-fuel ratio, and location of peak combustion pressure, among others.

Control module, module, control, controller, control unit, processor and similar terms mean any one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs or routines, combinational logic circuit(s), input/output circuit(s) and devices, appropriate signal conditioning and buffer circuitry, and other components to provide the described functionality. Software, firmware, programs, instructions, routines, code, algorithms and similar terms mean any instruction sets including calibrations and look-up tables. The control module has a set of control routines executed to provide the desired functions. Routines are executed, such as by a central processing unit, and are operable to monitor inputs from sensing devices and other networked control modules, and execute control and diagnostic routines to control operation of actuators. Routines may be executed at regular intervals, for example each 3.125, 6.25, 12.5, 25 and 100 milliseconds during ongoing engine and vehicle operation. Alternatively, routines may be executed in response to occurrence of an event.

In an exemplary embodiment, the turbocharger 10 is a variable geometry turbine (VGT) including a turbine 12 and a compressor 14. The compressor 14 is fluidly coupled to an intake conduit 2 for compressing fresh intake air from the environment. The turbine 12 can be a variable nozzle turbine (VNT) disposed in an exhaust conduit 16 of the exhaust system 40 for driving the compressor 14 through exhaust gas flow exiting the engine 6 from an exhaust manifold 8. The exhaust manifold 8 can interchangeably be referred to as an "exhaust gas manifold" herein.

In an exemplary embodiment, a charge air cooler 3 is fluidly coupled to the intake conduit 2 downstream of the compressor 14 of the turbocharger 10 for cooling the charged intake air before it reaches the intake manifold 4. After passing through the charge air cooler 3, the charged intake air is inlet to a plurality of intake ports through the intake manifold 4, each receiving the charged intake air passing through a known air metering device and a throttle device 5. Each cylinder defines a respective combustion chamber and includes one or more respective intake ports. An injected fuel mass is injected into each cylinder 7, and an air-fuel mixture including the charged intake air and the injected fuel mass is combusted and utilized to power the engine 6. The injected fuel mass can include pilot, main and post injections. In the exemplary embodiment, when the engine 6 is a diesel engine, the air-fuel mixture includes diesel fuel or diesel fuel blends. In alternative embodiments, when the engine 6 is a gasoline engine, the air-fuel mixture may include gasoline or gasoline blends, but the mixture may also include other flexible fuel types, such as ethanol or ethanol blends such as the fuel commonly known as E85. The methods described herein do not depend upon the particular variety of fuel used and are not intended to be limited to the embodiments disclosed herein.

The combusted air-fuel mixture is expelled from each cylinder 7 as an exhaust gas flow through the exhaust manifold 8. The exhaust gas flow can enter the exhaust system 40 and/or can enter the EGR circuit 20 for combustion in subsequent engine cycles. In an exemplary embodiment, the exhaust system 40 includes at least one aftertreatment device 18 in fluid communication with the exhaust conduit 16 downstream the turbine 12 of the turbocharger 10. When the engine 6 includes a diesel engine, the aftertreatment device 18 can include a diesel oxidation catalyst (DOC) for degrading residual hydrocarbons and carbon oxides contained in the exhaust gas flow. The aftertreatment device can further include a diesel particulate filter (DPF) fluidly coupled downstream of the DOC for capturing and removing diesel particulate matter (soot) from the exhaust gas flow. When the engine 6 includes a gasoline engine, the aftertreatment device 18 can include a three-way catalyst (TWC) for converting carbon oxides, hydrocarbons and oxides of nitrogen within the exhaust gas flow into carbon dioxide, nitrogen and water.

The EGR circuit 20 is fluidly coupled to the exhaust manifold 8 and is configured to selectively route back exhaust gas flow as EGR flow into the intake manifold 4. The EGR circuit 20 includes an EGR conduit 22 for directly fluidly coupling the exhaust manifold 8 with the intake manifold 4, an EGR cooler device 24 (e.g., EGR heat exchanger device) for cooling the exhaust gas flow and an EGR valve 30 downstream of the EGR cooler device 24 for controlling an EGR flow rate of exhaust gas flow through the EGR conduit 22. As used herein, the term "EGR flow" refers to exhaust gas flow that is routed through the EGR conduit 22. The EGR valve 30 is activated by control module 50. Various control methodologies for activating the EGR valve 30 under particular operating conditions are known in the art and will not be described in detail herein. The EGR valve 30, when controlled to an off position, blocks any exhaust gas flow from the exhaust manifold 8, the flow under a pressure gradient from the combustion process, from entering the intake manifold 4. The EGR valve 30, when controlled to an on or open position, opens, and the EGR circuit 20 can then utilize pressure and velocity of the exhaust gas flow to channel a portion of the exhaust gas flow to the intake manifold 4 as an EGR flow. The EGR valve 30, in some embodiments, is capable of opening partially, thereby modulating the amount of exhaust gas diverted into an EGR flow. It will be appreciated that the EGR valve 30 can be disposed upstream of the EGR cooler device 24. The EGR flow travels through the EGR circuit 20 to the intake manifold 4, where it is combined with at least the charged air portion of the air-fuel mixture in order to derive the combustion control properties enabled. The combustion process within the engine 6 is sensitive to conditions such as the temperature within the combustion chamber during combustion. EGR flow taken from a high temperature exhaust gas flow can increase the temperature within the combustion chamber to undesirable levels. Therefore, the EGR cooler device 24 removes heat from the EGR flow, thereby controlling the resulting temperature of the EGR flow eventually entering the combustion chamber. A cooling storage device 45 provides cooling via an inlet 26 to the EGR cooler device 24 that is recirculated back to the cooling storage device 45 via an outlet 28 of the EGR cooler device 24. Operation and efficiency of the EGR cooler device 24 is monitored by the control module 50. In one embodiment, the EGR cooler device 24 can be a gas to gas heat exchanger utilized to transfer heat from one gas flow to another. In another embodiment, the EGR cooler device 24 can be a gas to liquid heat exchanger utilized to transfer heat from a gas to a liquid. In the illustrated embodiment, the EGR cooler device 24 is a gas to liquid heat exchanger, wherein a high temperature EGR flow passes through EGR cooler device 24, transfers heat to a liquid medium in the form of an engine coolant liquid flow, the EGR flow thereafter exiting the EGR cooler device 24 as a reduced temperature EGR flow. Some known exemplary embodiments of EGR cooler device 24 include an engine coolant control device in communication with control module 50 capable of controlling flow and an amount of engine coolant liquid entering EGR cooler device 24, thereby controlling the amount of heat transferred from the EGR flow and controlling the reduction in temperature of the EGR flow. Under some operating conditions and configurations, the engine coolant liquid flow can be turned off such that EGR flow is delivered to the combustion chamber at a maximum temperature.

Heat exchangers and components thereof can be made of many materials. High temperatures exhibited within the exhaust gas flow influence the choice of materials used within heat exchangers coming into contact with the high temperature gases. In addition, corrosive combustion by-products present in the exhaust gases also influence the choice of materials used. Stainless steel is one known material used in exhaust components for its resistance to both high temperatures and corrosion. Certain other designs, wherein temperatures reaching the heat exchanger are somewhat lower and corrosive forces are mitigated, can utilize other materials such as aluminum. Other exemplary designs of heat exchangers utilize plastic or other synthetic materials, for example, to construct portions of headers or connective orifices wherein direct exposure to a higher temperature flow is not permitted. Heat exchangers are known to include various coatings to protect the structure of the heat exchanger or to impart other beneficial properties. The materials described above are given for example only. Choice of materials and coatings in particular heat exchangers are known in the art, and the materials and constructions of heat exchangers within this disclosure are not intended to be limited to the specific exemplary embodiments described herein.

Embodiments herein are directed towards mitigating fouling of the EGR cooler device 24. Fouling can occur as a result of by-products contained in the EGR flow resulting from combustion collecting on surfaces within gas flow passages of the EGR cooler device 24. The by-products collecting as surface deposits and forming a deposit layer within the EGR cooler device 24 can include particulate matter (PM), unburned hydrocarbons and other contaminants. The build-up of surface deposits within the EGR cooler device decreases the effectiveness and decreases the effective life of the EGR cooler device. PM and unburned hydrocarbon deposits left on the surfaces of the EGR cooler device 24 exposed to the gas flow act as an insulating blanket, decreasing the amount of heat that passes through the surfaces for a given temperature difference between the flow mediums. Accordingly, temperature differentials, or lack thereof, of the EGR cooler device 24 can indicate decreased heat transfer as a result of the fouling. Deposits built up upon the walls of the gas flow passages also decrease the effective cross sections of the gas flow passages, decreasing the flow of gas that flows through the gas flow passages of the EGR cooler device 24 for a given pressure difference across the EGR cooler device 24. Accordingly, pressure drops of the EGR cooler device 24 can indicate increased flow resistance resulting from fouling. Especially in the presence of elevated temperatures present in the engine compartment and the EGR flow, the surface deposits within the gas flow passages promote corrosion and other degradation of the EGR cooler device 24.

A surface deposit removing device is employed within the EGR circuit 20 to remove the surface deposit build-up from within the EGR cooler device 24. The surface deposit removing device can be periodically activated to remove the surface-deposit build-up. In one embodiment, the surface deposit removing device can include a first ultrasonic transducer fluidly coupled upstream of the EGR cooler device (e.g., heat exchanger device) 24. The first ultrasonic transducer is configured to remove the surface deposit build-up by producing sonic bursts to dislodge the surface deposit build-up when the first ultrasonic transducer is activated. In another embodiment, the surface deposit removing device can include an on-board dosing device fluidly coupled upstream of the EGR cooler device 24. The on-board dosing device is configured to remove the surface deposit build-up by injecting fluid into the EGR conduit 22 of the EGR circuit 20 to travel downstream with the EGR flow to enter the EGR cooler device 24 and remove the surface deposit build-up when the on-board dosing device is activated. In yet another embodiment, the surface deposit removing device can include a heating element in thermal contact with the EGR cooler device 24. The heating element can be configured to remove the surface deposit build-up from within the EGR cooler device 24 when electrically heated with power drawn from an electrical energy storage device when the heating element is activated. Embodiments are envisioned where the surface deposit removing device can include any combination of the first ultrasonic transducer, the on-board dosing device, and the heating element.

Figure 2:
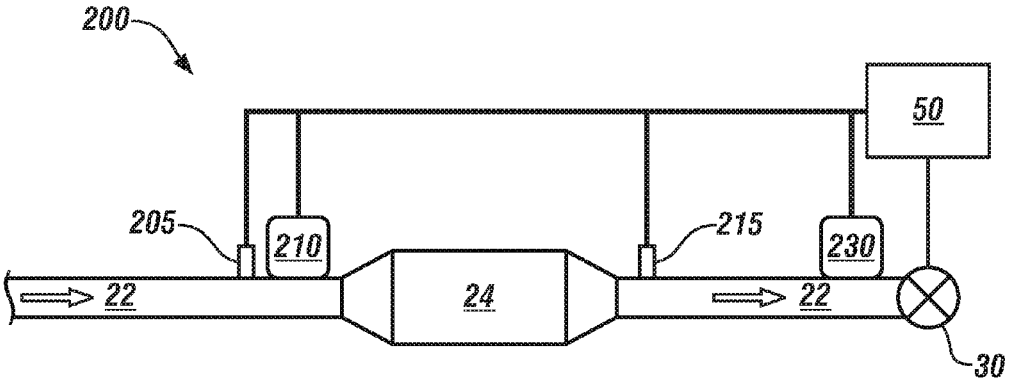
FIGS. 2, 4 and 6 illustrate detailed views of a portion 200 of the EGR circuit including a heat exchanger device and an EGR valve of FIG. 1, in accordance with the present disclosure.

FIG. 2 illustrates a more detailed view of the EGR cooler device 24 of the EGR circuit 20 encompassed by portion 200 of FIG. 1, in accordance with the present disclosure. In the illustrated non-limiting embodiment, the first ultrasonic transducer 210 or transmitter is disposed within or proximate to the EGR conduit 22 and upstream of the EGR cooler device 24. The first ultrasonic transducer 210 can be interchangeably referred to as an "upstream ultrasonic transducer." The first ultrasonic transducer 210 can be at any location upstream of the EGR cooler device 24. In other words, the first ultrasonic transducer 210 is fluidly coupled upstream of the EGR cooler device 210. As aforementioned, fouling of the EGR cooler device 24 can occur as a result of surface deposit build-up producing a deposit later in the flow passages of the EGR cooler device that reduces heat transfer and increases flow resistance. These surface deposits forming the deposit layer may include combustion by-products selected from the group consisting of PM (soot), unburned hydrocarbons and other contaminants that are difficult to remove. The first ultrasonic transducer 210 produces sonic bursts to dislodge the surface deposits from the flow passages within the EGR cooler device 24 when the first ultrasonic transducer 210 is activated. The dislodged surface deposits, or detached constituents of the deposit layer, are thereby transported by the EGR flow into the combustion chambers of the engine 6. The sonic bursts or pulsations produced by the transducer 210 also reduce particle transport to the surface walls within the EGR cooler device 24.

A first sensor 205 is disposed upstream of the EGR cooler device 24 and a second sensor 215 is disposed downstream of the EGR cooler device 24. In one embodiment, the first and second sensors 205, 215, respectively, can include pressure sensors for monitoring a pressure differential across the EGR device 24. The pressure differential can be monitored by the control module 50. If a pressure drop exceeds a fouling threshold, the control module 50 can command the transducer 210 to produce a sonic pulse to dislodge surface deposits, i.e., a deposit layer, within the EGR cooler device 24, wherein the detached constituents of the deposit layer are transported by the EGR flow to the intake manifold 4 for subsequent combustion.

In another embodiment, the first and second sensors 205, 215, respectively, can include temperature sensors for measuring temperature differential across the EGR cooler device 24. The temperature differential can be monitored by the control module 50. If the temperature does not exceed a clean threshold, the control module 50 can command the transducer 210 to produce a sonic pulse to dislodge surface deposits, i.e., a deposit layer, within the EGR cooler device 24, wherein the detached constituents of the deposit layer are transported by the EGR flow to the intake manifold 4 for subsequent combustion. It will be understood that a fouled EGR cooler device 24 would result in minimal temperature differential due to the reduced heat transfer capabilities. Embodiments envisioned further include utilizing both temperature and pressure sensors upstream of the EGR cooler device 24 and both temperature and pressure sensors downstream of the EGR cooler device 24.

In another exemplary embodiment, a second ultrasonic transducer 230 or transmitter can be additionally disposed within or proximate to the EGR conduit 22 and between the EGR cooler device 24 and the EGR valve 30. It will be understood that fouling of the EGR valve 30 can also occur as a result of surface deposit build-up producing a deposit layer on the EGR valve 30 that increases flow resistance. The second ultrasonic transducer 230 produces sonic bursts to dislodge the surface deposits from the surfaces of the EGR valve 30 when the second ultrasonic transducer 230 is activated. The dislodged surface deposits, or detached constituents of the deposit layer, are thereby transported by the EGR flow for combustion in subsequent engine cycles. The control module 50 can command the second ultrasonic transducer 230 when activated to produce the sonic bursts when the first ultrasonic transducer 210 is producing sonic bursts. The second ultrasonic transducer 230 can be interchangeably referred to as a "downstream ultrasonic transducer."

Figure 3:
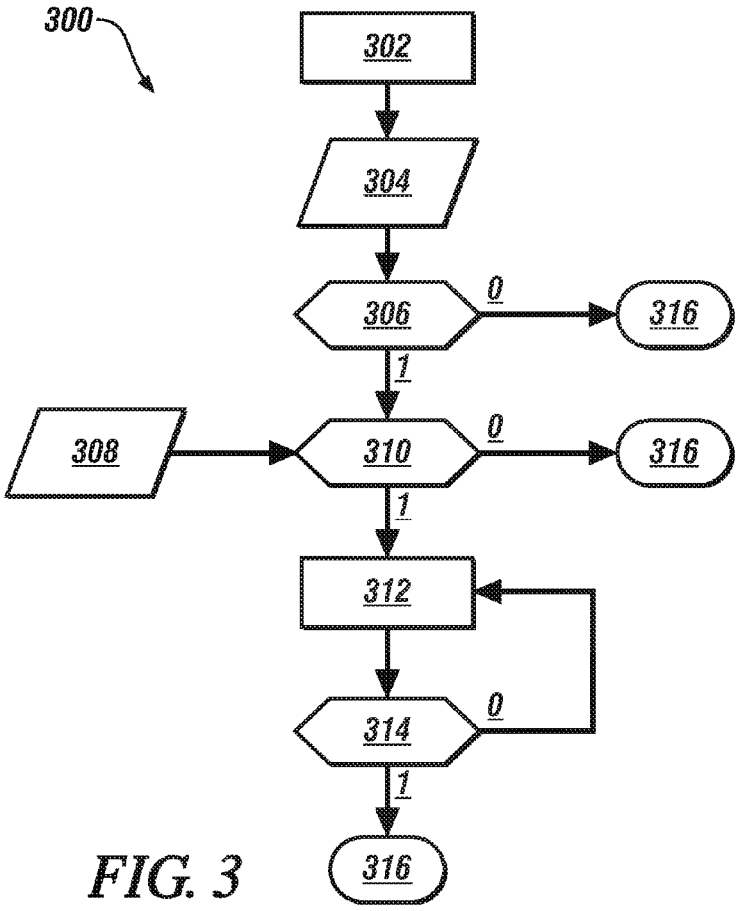
FIG. 3 illustrates a flowchart for activating an ultrasonic transducer to produce sonic bursts to dislodge and remove surface deposits within the heat exchanger device of FIG. 1, in accordance with the present disclosure.

FIG. 3 illustrates a flowchart 300 for activating an ultrasonic transducer to produce sonic bursts to dislodge and remove surface deposits within the EGR cooler device 24 of FIG. 1, in accordance with the present disclosure. It will be appreciated that the exemplary flowchart 300 can be implemented within the control module 50 illustrated in FIG. 1. The flowchart 300 can be described with reference to FIG. 2 that provides the detailed description of the EGR cooler device 24 of the EGR circuit 20 encompassed by portion 200 of FIG. 1. Table 1 is provided as a key to FIG. 3 wherein the numerically labeled blocks and the corresponding functions are set forth as follows.

TABLE 1

| BLOCK | BLOCK CONTENTS |
|---|---|
| 302 | Start. |
| 304 | Monitor a pressure differential across the EGR cooler device. |
| 306 | Does the pressure differential across the EGR cooler device exceed a fouling threshold? |
| 308 | Monitor engine operating conditions. |
| 310 | Are the engine operating conditions suitable for activation of the first ultrasonic transducer device? |
| 312 | Activate the first ultrasonic transducer device. |
| 314 | Is the pressure differential across the EGR cooler device less than the pressure clean threshold? |
| 316 | Stop. |

The flowchart 300 starts at block 302 and proceeds to block 304 wherein a pressure differential, e.g., a pressure drop, is measured across the EGR cooler device 24. The pressure differential can be measured when the first and second sensors 205, 215, respectively, include pressure sensors. It will be appreciated that block 304 can additionally or alternatively monitor and detect temperature differential across the EGR cooler device 24 when the first and second sensors 205, 215, respectively, include temperature sensors.

Decision block 306 compares the pressure differential across the EGR cooler device 24 to a fouling threshold. If the pressure differential does not exceed the fouling threshold, as denoted by a "0", the flowchart 300 stops at block 316. If the pressure differential exceeds the fouling threshold, as denoted by a "1", the flowchart proceeds to decision block 310. Additionally or alternatively, temperature differential across the EGR cooler device 24 can be compared to a temperature clean threshold relating to temperature. For instance, if the temperature differential is greater than the temperature clean threshold, the flow chart 300 stops. If the temperature differential is less than the temperature clean threshold, the flowchart 300 proceeds to decision block 310.

Decision block 310 determines whether engine operating conditions are suitable for activation of the first ultrasonic transducer 210 to produce a sonic blast. Block 308 monitors engine operating conditions such as the velocity of the exhaust gas flow output from the engine 6. Engine operating conditions suitable for activating the first ultrasonic transducer 210 can include the velocity of the exhaust gas flow having a sufficient velocity to carry dislodged soot from the EGR cooler device 24 to the intake manifold 4. For instance, if the velocity of the exhaust gas flow exceeds a velocity threshold, the velocity of the exhaust gas flow can be deemed sufficient for carrying dislodged soot particles. Block 308 can further monitor the EGR valve 30, wherein conditions suitable for activating the transducer 210 can include the opening of the EGR valve 30 to determine whether the EGR flow has a sufficient velocity to carry dislodged soot from the EGR cooler device 24 to the intake manifold 4. For instance, if the opening of the EGR valve 30 is greater than an opening threshold, the velocity of the EGR flow can be deemed sufficient for carrying dislodged soot particles. In a non-limiting example, the opening of the EGR valve 30 is measured as a percentage and the opening threshold is 75 percent open. If decision block 310 determines the engine operating conditions and/or the opening of the EGR valve 30 are suitable for activation of the first ultrasonic transducer 210 to produce the sonic blast, as denoted by a "1", the flowchart proceeds to block 312. If decision block 310 determines engine operating conditions and/or the opening of the EGR valve 30 are not suitable for activation of the first ultrasonic transducer 210 to produce the sonic blast, as denoted by a "0", the flowchart 300 stops at block 316. If conditions are suitable, the transducer is activated in block 312. When the first ultrasonic transducer 210 is activated in block 312, the control module 50 commands the transducer 210 to produce sonic bursts/blasts to dislodge and remove the surface deposits from the flow passages within the EGR cooler device 24.

Decision block 314 determines whether the pressure differential across the EGR cooler device 24 is lower than a pressure clean threshold. If the pressure differential is greater than the pressure clean threshold, as denoted by a "0", the flowchart reverts back to block 312 where the first ultrasonic transducer 210 remains activated. If the pressure differential is not greater than the pressure clean threshold, as denoted by a "1", the flowchart 300 is stopped at block 316 and the first ultrasonic transducer 210 is deactivated or stopped. The pressure clean threshold can be the same as the fouling threshold or the pressure clean and fouling thresholds can be different values. Additionally or alternatively, decision block 314 can determine whether the temperature differential across the EGR cooler device 24 is greater than the temperature clean threshold. If the temperature differential is less than the temperature clean threshold, as denoted by a "0", the flowchart reverts back to block 312 where the first ultrasonic transducer 210 remains activated. If the temperature differential is not less than the temperature clean threshold, as denoted by a "1", the flowchart 300 is stopped at block 316 and the first ultrasonic transducer 210 is deactivated or stopped.

Figure 4:
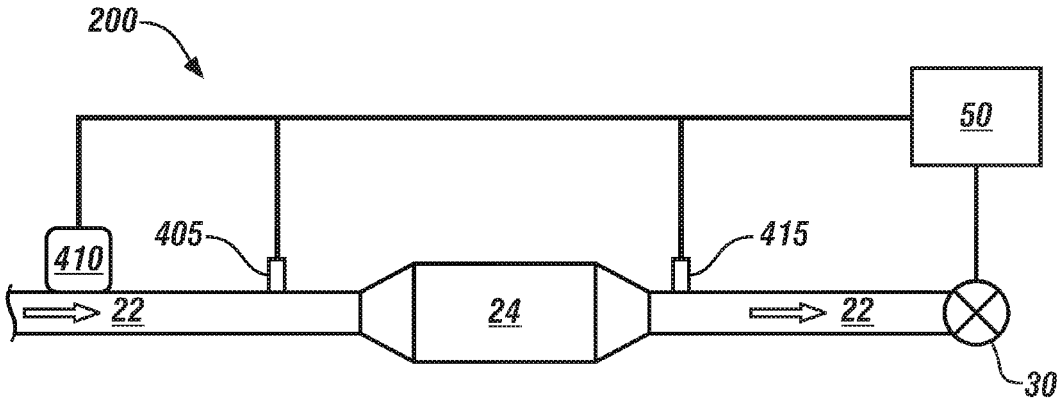

FIG. 4 illustrates in more detail the EGR cooler device 24 of the EGR circuit 20 encompassed by portion 200 of FIG. 1, in accordance with the present disclosure. In the illustrated embodiment, the on-board dosing device 410 is disposed within or proximate to the EGR conduit 22 and upstream of the EGR cooler device 24. The on-board dosing device 410 can be at any location upstream of the EGR cooler device 24. In other words, the on-board dosing device is fluidly coupled upstream of the EGR cooler device 24. As aforementioned, fouling of the EGR cooler device 24 can occur as a result of surface deposit build-up producing a deposit layer that reduces heat transfer of the EGR cooler device 24 and increases flow resistance. These surface deposits forming the deposit layer may include PM (soot), unburned hydrocarbons and other contaminants are difficult to remove. The on-board dosing device 410 injects fluid into the EGR conduit 22 to travel downstream with EGR flow to enter the EGR cooler device 24 and result in the removal of the surface deposit build-up when the on-board dosing 410 device is activated. The injected fluid can be selected from the group consisting of: windshield washer fluid, water, and urea.

In one embodiment, the injected fluid undergoes a phase change that vaporizes the injected fluid within the hot EGR flow to result in the removal of the surface deposit build-up from the flow passages within the EGR cooler device 24. The removed surface deposits, or detached constituents of the deposit layer, are thereby transported by the EGR flow into the combustion chamber of the engine 6. Exemplary embodiments of the fluid include windshield washer fluid, water or urea. Urea can be obtained from a urea dosing device used in the exhaust system for treating NOx in a selective catalytic reduction device when the engine 6 includes a diesel engine. In one embodiment, the on-board dosing device 410 is a urea dosing device also used for treating NOx in a selective catalytic reduction device.

In another exemplary embodiment, the injected fluid undergoes a chemical reaction within the EGR cooler device 24 to result in the removal of the surface deposit build-up from the flow passages within the EGR cooler device 24. The removed surface deposits, or detached constituents of the deposit layer, are thereby transported by the EGR flow into the combustion chamber of the engine 6. Exemplary embodiments of the fluid include windshield washer fluid, water or urea.

A first sensor 405 is disposed upstream of the EGR cooler device 24 and a second sensor 415 is disposed downstream of the EGR cooler device 24. In one embodiment, the first and second sensors 405, 415, respectively, can include pressure sensors for monitoring a pressure differential across the EGR device 24. The pressure differential can be monitored by the control module 50. If the pressure differential exceeds a fouling threshold, the control module 50 can command the on-board dosing device 410 to inject the fluid into the exhaust gas flow and/or EGR flow to remove the surface deposit build-up, i.e., a deposit layer, within the EGR cooler device 24, wherein the detached constituents of the deposit layer are transported by the EGR flow to the intake manifold 4 for subsequent combustion.

Additionally or alternatively, the first and second sensors 405, 415, respectively, can include temperature sensors for measuring temperature differential across the EGR cooler device 24. The temperature differential can be monitored by the control module 50. If the temperature does not exceed a clean threshold, the control module 50 can command the on-board fluid device 410 to inject fluid into the exhaust gas flow and/or EGR flow to remove the surface deposit build-up, i.e., a deposit layer, within the EGR cooler device 24, wherein the detached constituents of the deposit layer are transported by the EGR flow to the intake manifold 4 for subsequent combustion. Embodiments envisioned further include utilizing both temperature and pressure sensors upstream of the EGR cooler device 24 and both temperature and pressure sensors downstream of the EGR cooler device 24.

Figure 5:
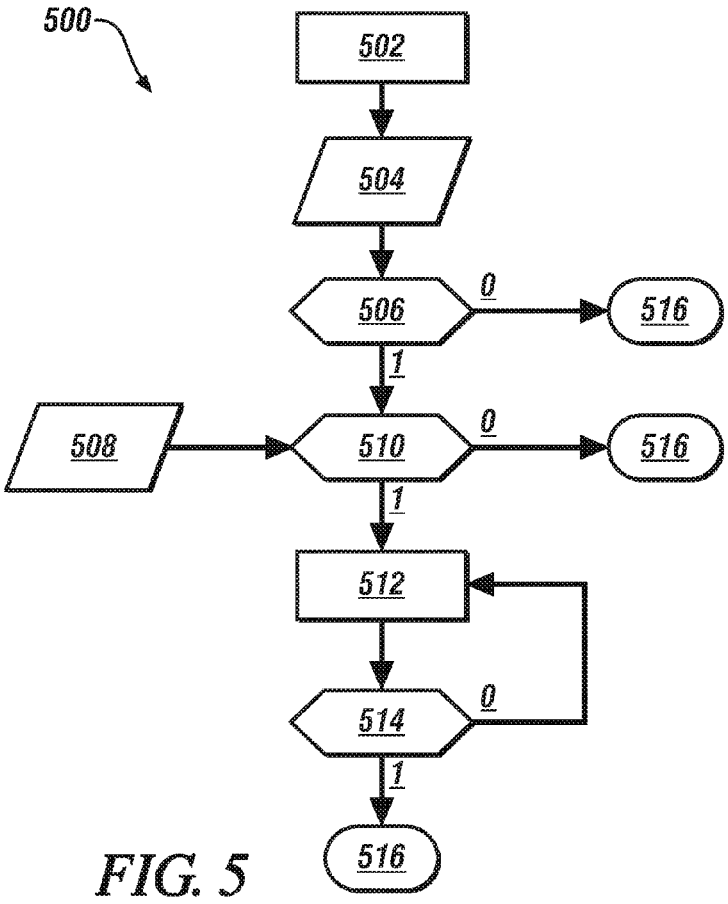
FIG. 5 illustrates a flowchart for activating an on-board dosing device to remove surface deposits within the heat exchanger device of FIG. 1, in accordance with the present disclosure.

FIG. 5 illustrates a flowchart for activating an on-board dosing device to remove surface deposit build-up from flow passages within the heat exchanger device of FIG. 1, in accordance with the present disclosure. It will be appreciated that the exemplary flowchart 500 can be implemented within the control module 50 illustrated in FIG. 1. The flowchart 500 can be described with reference to FIG. 4 that provides the detailed description of the EGR cooler device 24 of the EGR circuit 20 encompassed by portion 200 of FIG. 1. Table 2 is provided as a key to FIG. 5 wherein the numerically labeled blocks and the corresponding functions are set forth as follows.

TABLE 2

| BLOCK | BLOCK CONTENTS |
|---|---|
| 502 | Start. |
| 504 | Monitor a pressure differential across the EGR cooler device. |
| 506 | Does the pressure differential across the EGR cooler device exceed a fouling threshold? |
| 508 | Monitor engine operating conditions. |
| 510 | Are the engine operating conditions suitable for fuel dosing? |
| 512 | Activate the on-board dosing device. |
| 514 | Is the pressure differential across the EGR cooler device less than a pressure clean threshold? |
| 516 | Stop. |

The flowchart 500 starts at block 502 and proceeds to block 504 wherein a pressure differential, e.g., a pressure drop, is measured across the EGR cooler device 24. The pressure differential can be measured when the first and second sensors 405, 415, respectively, include pressure sensors. It will be appreciated that block 504 can monitor and detect temperature differential across the EGR cooler device 24 when the first and second sensors 405, 415, respectively, include temperature sensors.

Decision block 506 compares the pressure differential across the EGR cooler device 24 to a fouling threshold. If the pressure differential does not exceed the fouling threshold, as denoted by a "0", the flowchart 500 stops at block 516. If the pressure differential exceeds the fouling threshold, as denoted by a "1", the flowchart proceeds to decision block 510. Additionally or alternatively, temperature differential across the EGR cooler device 24 can be compared to a temperature clean threshold relating to temperature. For instance, if the temperature differential is greater than the temperature clean threshold, the flowchart 500 stops. If the temperature differential is less than the temperature clean threshold, the flowchart 500 proceeds to decision block 510.

Decision block 510 determines whether engine operating conditions are suitable for activation of the on-board dosing device 410 to inject fluid into the EGR conduit 22 to travel downstream with the EGR flow to enter the EGR cooler device 24. Block 508 monitors engine operating conditions such as the velocity of the exhaust gas flow output from the engine 6. Engine operating conditions suitable for activating the on-board dosing device 410 can include the velocity of the exhaust gas flow having a sufficient velocity to carry dislodged soot from the EGR cooler device 24 to the intake manifold 4. For instance, if the velocity of the exhaust gas flow exceeds a velocity threshold, the velocity of the exhaust gas flow can be deemed sufficient for carrying dislodged soot particles. Block 308 can further monitor the EGR valve 30, wherein conditions suitable for activating the on-board dosing device 410 can include the opening of the EGR valve 30 to determine whether the EGR flow has a sufficient velocity to carry dislodged soot from the EGR cooler device 24 to the intake manifold 4. For instance, if the opening of the EGR valve 30 is greater than an opening threshold, the velocity of the EGR flow can be deemed sufficient for carrying dislodged soot particles. In a non-limiting example, the opening of the EGR valve 30 is measured as a percentage and the opening threshold is 75 percent open. If decision block 510 determines the engine operating conditions and/or the opening of the EGR valve 30 are suitable for activation of the on-board dosing device 410 to inject fluid in the EGR conduit 22, as denoted by a "1", the flowchart proceeds to block 512. If decision block 510 determines engine operating conditions and/or the opening of the EGR valve 30 are not suitable for activation of the on-board dosing device 410 to inject fluid in the EGR conduit 22, as denoted by a "0", the flowchart 500 stops at block 516. If conditions are suitable, the on-board dosing device 410 is activated in block 512. When the on-board dosing device 410 is activated in block 512, the control module 50 commands the on-board dosing device to inject fluid into the EGR conduit to result in the removal of the surface deposit build-up from the flow passages within the EGR cooler device 24.

Decision block 514 determines whether the pressure differential across the EGR cooler device 24 is lower than a pressure clean threshold. If the pressure differential is greater than the pressure clean threshold, as denoted by a "0", the flowchart reverts back to block 512 where the on-board dosing device 410 remains activated. If the pressure differential is not greater than the pressure clean threshold, as denoted by a "1", the flowchart 500 is stopped at block 516 and the on-board dosing device 410 is deactivated or stopped. The pressure clean threshold can be the same as the fouling threshold or the pressure clean and fouling thresholds can be different values. Additionally or alternatively, decision block 514 can determine whether the temperature differential across the EGR cooler device 24 is greater than the temperature clean threshold. If the temperature differential is less than the temperature clean threshold, as denoted by a "0", the flowchart reverts back to block 512 where the on-board dosing device 410 remains activated. If the temperature differential is not less than the temperature clean threshold, as denoted by a "1", the flowchart 500 is stopped at block 516 and the on-board dosing device 410 is deactivated or stopped.

Figure 6:
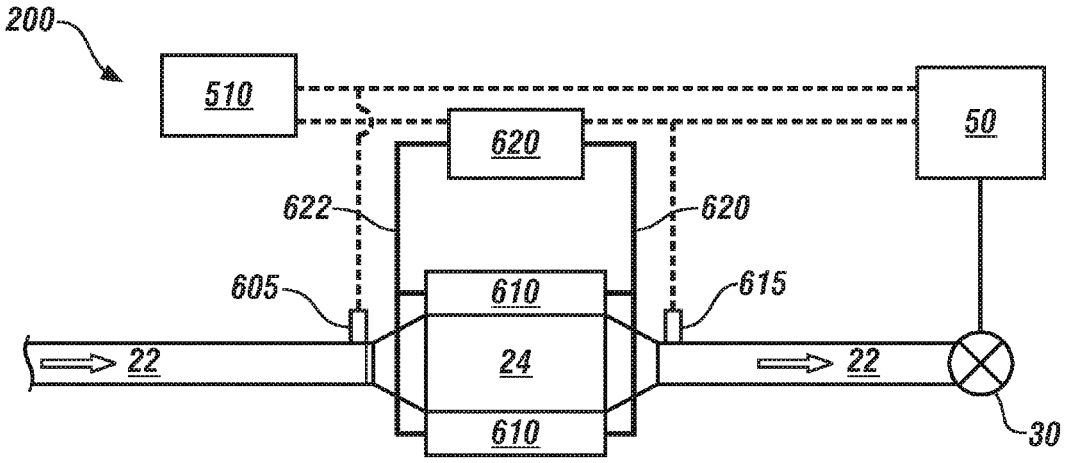

FIG. 6 illustrates a more detailed view of the EGR cooler device 24 of the EGR circuit 20 encompassed by portion 200 of FIG. 1, in accordance with the present disclosure. In an exemplary embodiment, the heating element 610 is in thermal contact with the EGR cooler device 24. As aforementioned, fouling of the EGR cooler device 24 can occur as a result of surface deposit build-up producing a deposit layer that reduces heat transfer of the EGR cooler device 24 and increases flow resistance. These surface deposits forming the deposit layer may include PM (soot), unburned hydrocarbons and other contaminants are difficult to remove. Accordingly, and in an exemplary embodiment, the heating element 610 can be electrically heated by drawing power from an electrical energy storage device (ESD) 620 to remove or dry out the surface deposits from the flow passages within the EGR cooler device 24. The removed surface deposits, or detached constituents of the deposit layer, are thereby transported by the EGR flow into the combustion chamber of the engine 6. In another embodiment, the heating element 610 can be electrically heated by drawing power from the electrical energy storage device (ESD) 620 to change the morphology of the surface deposits making these deposits more susceptible to being removed by fluid shear forces within the EGR flow. The ESD 620 can include a battery or a capacitor and can be charged by a charging device 630 such as an alternator or by any known charging methods. The power is drawn from the ESD 620 to the heating element 610 via positive and negative terminals 622, 620, respectively.

Figure 7:
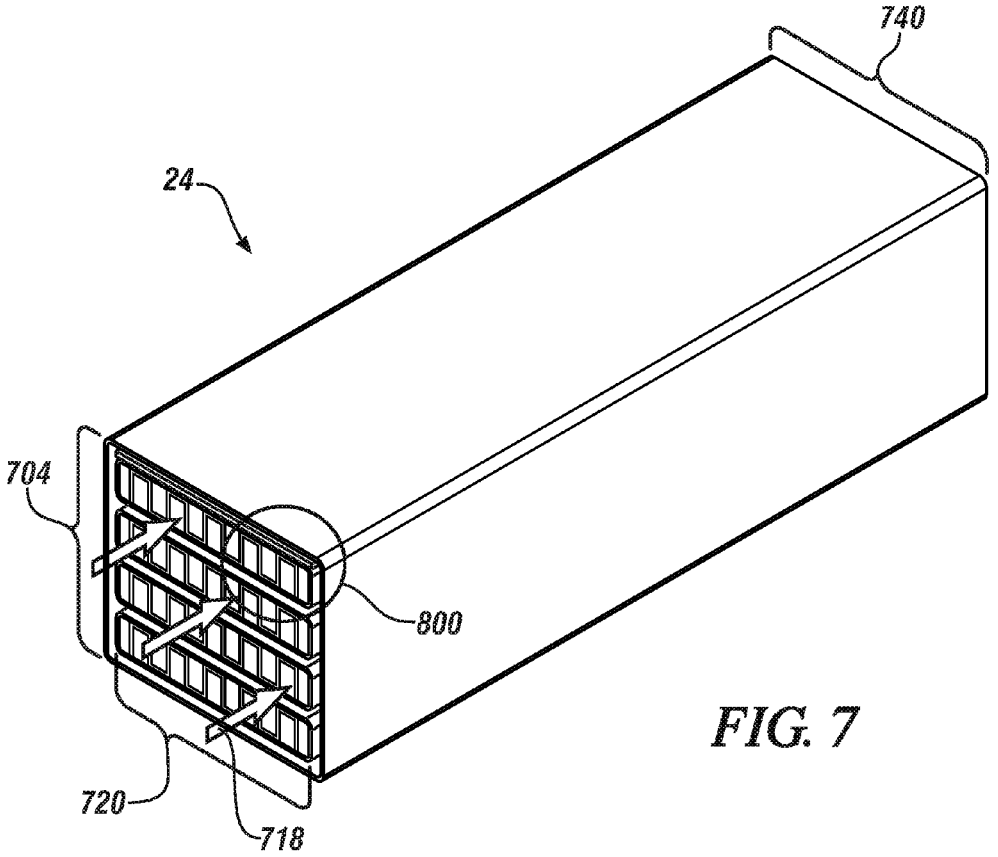
FIG. 7 illustrates a cross-sectional view of the heat exchanger device of FIG. 6, in accordance with the present disclosure.

FIG. 7 illustrates a cross-sectional view of the EGR cooler device 24 of FIG. 6, in accordance with the present disclosure. The EGR cooler device 24 can be a gas to liquid heat exchanger device or a gas to gas heat exchanger device. The EGR cooler device 24 includes an EGR flow inlet section 720, a gas outlet section 740, a plurality of gas flow passages 704, and a shell. The exhaust gas flow passages 704 are arranged in rows and can include flow tubes in one embodiment. Each row is separated by a gap for coolant to flow through. The shell surrounds and encloses the gas flow passages 704 and seals with an inlet endplate associated with the inlet section 720 and an outlet endplate associated with the outlet section 740. Exhaust gas flow (e.g., EGR flow 718) enters the EGR cooler device 24 through the gas inlet section 720, flows through the exhaust gas flow passages 704, and exits the EGR cooler device 24 through the gas outlet section 740. It will be understood that the exhaust gas flow passages 704 are in direct contact with coolant flow on the outside of the hotter gas flow on the inside of the passages 704. Accordingly, heat can be transferred through fins of each passage 704, cooling the gas flow and warming the liquid flow (or gas flow if a gas to gas EGR cooler device). In this way, the EGR cooler device 24 enables the cooling of a hot EGR flow 718.

Figure 8:
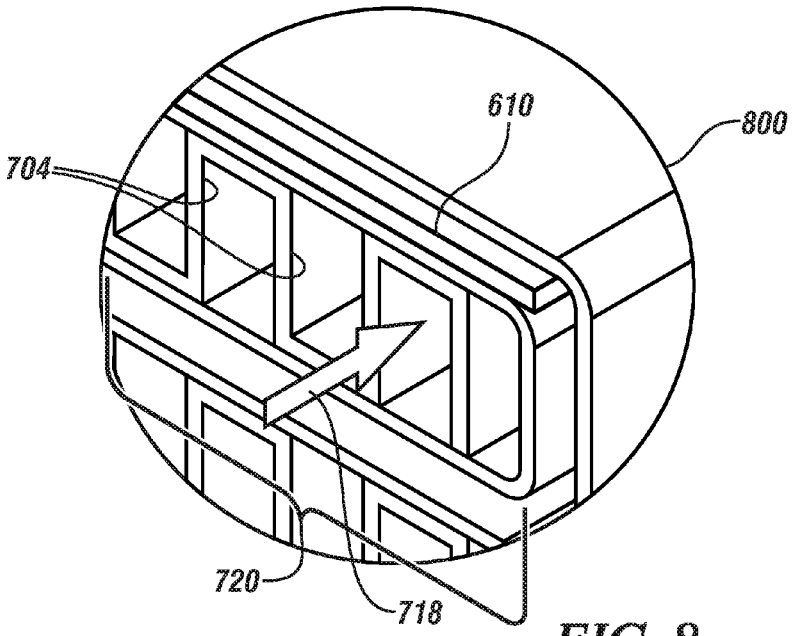
FIG. 8 illustrates a detailed view 800 of the heat exchanger device of FIG. 7, in accordance with the present disclosure.

FIG. 8 illustrates a detailed view of the cross-section of the EGR cooler device 25 encompassed by portion 800 of FIG. 7, in accordance with the present disclosure. Exhaust gas flow (e.g., EGR flow 718) enters each gas flow passage 704, wherein each of the passages 704 in the row are separated by fins 804. The heating element 610 (e.g., see FIG. 6) overlays each row of the gas flow passages 704 from the gas inlet section 720 to the gas outlet section 720. Thus, the heating element 610 is in thermal contact with the EGR cooler device.

With reference to FIGS. 1, 6 and 8, embodiments are directed toward electrically heating the heating element 610 only during opportunistic conditions. As used herein, the term "opportunistic conditions" refer to conditions when EGR cooling is not required or when EGR is not being used. The opportunistic conditions can occur during periods of engine idling, deceleration events, and cold engine start events. Opportunistic conditions can additionally occur during periods when the EGR valve 30 is closed, i.e., the EGR cooler device 24 is not being utilized. Accordingly, the control module 50 can monitor the engine 6, the EGR valve 30 and the EGR cooler device 24 to determine when opportunistic conditions are occurring and are present. When opportunistic conditions are present, the control module 50 can command the ESD 620 to supply power for electrically heating the heating element 610. It will be understood that a plurality of heating elements 610 can be present, each one overlying a row of exhaust gas flow passages 704. The heating elements may additionally, or separately, underlie each row of gas flow passages.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Apparatus for mitigating fouling within a heat exchanger device, comprising:

an internal combustion engine fluidly coupled to an intake gas manifold upstream of the engine and an exhaust gas manifold downstream of the engine; and an external exhaust gas recirculation (EGR) circuit fluidly coupled to the exhaust gas manifold at a first end and configured to selectively route back exhaust gas flow as EGR flow into the intake gas manifold at a second end, the EGR circuit including:

the heat exchanger device for cooling the EGR flow prior to entering the intake gas manifold, and a surface deposit removing device configured to remove surface deposit build-up from within the heat exchanger device when the surface deposit removing device is activated; and a control module configured to:

monitor a pressure differential across the heat exchanger device;

compare the monitored pressure differential to a threshold pressure differential;

monitor engine operating conditions including a velocity of the exhaust gas flow, and an operating state of an EGR valve;

compare the monitored velocity of the exhaust gas flow to a threshold exhaust gas flow velocity;

determine whether opportunistic conditions are present based on the monitored engine operating conditions, including:

when the EGR valve is in a closed state the opportunistic conditions are present;

when the EGR valve is not in a closed state the opportunistic conditions are present when the engine operating conditions indicate that cooling of the EGR flow is not required, or that EGR is not being used; and activate the surface deposit removing device when the monitored pressure differential exceeds the threshold pressure differential; the monitored velocity of the exhaust gas flow exceeds the threshold exhaust gas flow velocity; and the opportunistic conditions are present.

2. The apparatus of claim 1, wherein the surface deposit removing device comprises at least one of:

an upstream ultrasonic transducer fluidly coupled upstream of the heat exchanger device and configured to remove the surface deposit build-up by producing sonic bursts to dislodge the surface deposit build-up when the upstream ultrasonic transducer is activated; and an on-board dosing device fluidly coupled upstream of the heat exchanger device and configured to remove the surface deposit build-up by injecting fluid into the EGR circuit to travel downstream with the EGR flow to enter the heat exchanger device and remove the surface deposit build-up when the on-board dosing device is activated.

3. The apparatus of claim 2, wherein the fluid injected by the on-board dosing device into the EGR circuit vaporizes within the EGR flow to result in the removal of the surface deposit build-up.

4. The apparatus of claim 2, wherein the fluid injected by the on-board dosing device into the EGR circuit undergoes a chemical reaction within the heat exchanger device to result in the removal of the surface deposit build-up.

5. The apparatus of claim 2, wherein the injected fluid by the on-board dosing device is selected from the group consisting of: windshield washer fluid, water, and urea.

6. The apparatus of claim 2, wherein the EGR circuit further comprises a first pressure sensor disposed upstream of the heat exchanger device and a second pressure sensor disposed downstream of the heat exchanger device, the surface deposit removing device being activated to remove the surface deposit build-up from within the heat exchanger device when a pressure differential measured by the first and second pressure sensors exceeds a fouling threshold.

7. The apparatus of claim 2, wherein the EGR circuit further comprises a first temperature sensor disposed upstream of the heat exchanger device and a second temperature sensor disposed downstream of the heat exchanger device, the surface deposit removing device being activated to remove the surface deposit build-up from within the heat exchanger device when a temperature differential measured by the first and second temperature sensors does not exceed a temperature clean threshold.

8. The apparatus of claim 1, wherein the surface deposit removing device comprises:

a heating element in thermal contact with the heat exchanger device and configured to remove the surface deposit build-up from within the heat exchanger device when electrically heated with power drawn from an electrical energy storage device when the heating element is activated.

9. The apparatus of claim 1, wherein the opportunistic conditions being present further comprises a period of at least one of engine idling, engine deceleration events, and cold engine start events.

10. The apparatus of claim 1, wherein the EGR circuit further comprises a downstream ultrasonic transducer fluidly coupled downstream of the heat exchanger device and fluidly coupled upstream of an EGR valve, the downstream ultrasonic transducer configured to produce sonic bursts to dislodge surface deposit build-up from surfaces of the EGR valve.

11. The apparatus of claim 1, wherein the heat exchanger device comprises:

an inlet section for receiving the EGR flow;

a plurality of gas flow passages arranged in rows, each row separated by a gap for coolant to flow through; and an outlet section at which the EGR flow exits after being received by the inlet section and passing through the plurality of gas flow passages.

12. Method for mitigating fouling within a exhaust gas recirculation (EGR) cooler device, comprising:

selectively routing exhaust gas flow output from an internal combustion engine through an external EGR circuit, the EGR circuit fluidly coupled to an exhaust gas manifold downstream of the engine at a first end and fluidly coupled to an intake gas manifold upstream of the engine at a second end;

cooling the exhaust gas flow within an EGR cooler device of the EGR circuit prior to entering the intake gas manifold;

monitoring a pressure differential across the heat exchanger device;

comparing the monitored pressure differential to a threshold pressure differential;

monitoring engine operating conditions including a velocity of the exhaust gas flow, and an operating state of an EGR valve;

comparing the monitored velocity of the exhaust gas flow to a threshold exhaust gas flow velocity;

determining whether opportunistic conditions are present based on the monitored engine operating conditions, including:

when the EGR valve is in a closed state the opportunistic conditions are present;

when the EGR valve is not in a closed state the opportunistic conditions are present when the engine operating conditions indicate that cooling of the EGR flow is not required, or that EGR is not being used; and activating a surface deposit removing device to remove surface deposit build-up from within the EGR cooler device when the monitored pressure differential exceeds the threshold pressure differential; the monitored velocity of the exhaust gas flow exceeds the threshold exhaust gas flow velocity: and the opportunistic conditions are present.

13. The method of claim 12, wherein activating the surface deposit removing device further requires that at least one of a monitored pressure differential across the EGR cooler device is greater than a fouling threshold and a monitored temperature differential across the EGR cooler device is less than a temperature clean threshold, the surface deposit removing device comprising one of:

an upstream ultrasonic transducer fluidly coupled upstream of the EGR cooler device and commanded to produce sonic bursts to dislodge and remove the surface deposit build-up when the upstream ultrasonic transducer is activated; and an on-board dosing device fluidly coupled upstream of the heat exchanger device and commanded to inject fluid into the EGR circuit to travel downstream with the EGR flow to enter the EGR cooler device and result in the removal of the surface deposit build-up when the on-board dosing device is activated.

14. The method of claim 13, further comprising:

when the upstream ultrasonic transducer device is activated, commanding a downstream ultrasonic transducer fluidly coupled downstream of the EGR cooler device to produce sonic bursts to dislodge and remove surface deposit build-up from surfaces of an EGR valve downstream of the EGR cooler device.

15. The method of claim 13, wherein the surface deposit removing device remains activated until at least one of the monitored pressure differential across the EGR cooler device is less than a pressure clean threshold and the monitored temperature differential is greater than the temperature clean threshold.

16. The method of claim 13, further comprising:

monitoring an EGR valve downstream of the heat exchanger device for controlling an EGR flow rate of exhaust gas flow through the EGR circuit;

comparing an opening of the EGR valve to an opening threshold; and activating the surface deposit removing device only if the opening of the EGR valve is greater than the opening threshold.

17. The method of claim 13, wherein the pressure differential is monitored based on a difference between a first pressure measured upstream of the EGR cooler device and a second pressure measured downstream of the EGR cooler device.

18. The method of claim 13, wherein the temperature differential is monitored based on a difference between a first temperature measured upstream of the EGR cooler device and a second temperature measured downstream of the EGR cooler device.

19. The method of claim 12, wherein activating the surface deposit removing device further comprises:

monitoring operation of the engine;

monitoring an opening of an EGR valve downstream of the heat exchanger device for controlling an EGR flow rate of exhaust gas flow through the EGR circuit; and when the surface deposit removing device comprises a heating element in thermal contact with the EGR cooler device, commanding an electrical energy storage device to supply power for electrically heating the heating element resulting in the removal of the surface deposit build-up from within the EGR cooler device during opportunistic conditions based on the monitored operation of the engine and the monitored opening of the EGR valve.

20. Apparatus for mitigating fouling within an exhaust gas recirculation (EGR) cooler device, comprising:

an internal combustion engine fluidly coupled to an intake gas manifold upstream of the engine and an exhaust gas manifold downstream of the engine;

an EGR circuit fluidly coupled to the exhaust gas manifold at a first end and configured to selectively route back exhaust gas flow as EGR flow into the intake gas manifold at a second end, the EGR circuit including:

an EGR cooler device for cooling the EGR flow prior to entering the intake gas manifold, and a surface deposit removing device configured to remove surface deposit build-up from within the EGR cooler device when the surface deposit removing device is activated, the surface deposit removing device comprising one of:

an ultrasonic transducer fluidly coupled upstream of the EGR cooler device and configured to remove the surface deposit build-up from within the EGR cooler device by producing sonic bursts to dislodge the surface deposit build-up, an on-board dosing device coupled upstream of the EGR cooler device and configured to remove the surface deposit build-up from within the EGR cooler device by injecting fluid into the EGR circuit to travel downstream with the EGR flow to enter the EGR cooler device and result in the removal of the surface deposit build-up, and a heating element in thermal contact with the EGR cooler device and configured to remove the surface deposit build-up from within the EGR cooler device when electrically heated; and a control module configured to:

monitor a pressure differential across the heat exchanger device;

compare the monitored pressure differential to a threshold pressure differential;

monitor engine operating conditions including a velocity of the exhaust gas flow, and an operating state of an EGR valve;

compare the monitored velocity of the exhaust gas flow to a threshold exhaust gas flow velocity;

determine whether opportunistic conditions are present based on the monitored engine operating conditions, including:

when the EGR valve is in a closed state the opportunistic conditions are present;

when the EGR valve is not in a closed state the opportunistic conditions are present when the engine operating conditions indicate that cooling of the EGR flow is not required, or that EGR is not being used; and activate the surface deposit removing device when the monitored pressure differential exceeds the threshold pressure differential; the monitored velocity of the exhaust gas flow exceeds the threshold exhaust gas flow velocity; and the opportunistic conditions are present.

* * * * *